US005487936A

United States Patent [19]

Collier

[11] Patent Number: 5,487,936

[45] Date of Patent: Jan. 30, 1996

[54] TEXTILE FABRICS OF DIFFERENTIAL WEAVE COMPRISING MULTIFILAMENT THREADS WHEREIN INDIVIDUAL FILAMENTS HAVE A LINEAR DENSITY OF ONE DECITEX OR LESS

[75] Inventor: Susan J. Collier, London, United Kingdom

[73] Assignee: Collier Campbell Ltd., Northside, England

[21] Appl. No.: 217,148

[22] Filed: Mar. 24, 1994

[30] Foreign Application Priority Data

Mar. 21, 1994 [GB] United Kingdom ..... 940554604

[51] Int. Cl.[6] ..... D06P 3/82; B32B 7/00; D03D 15/00

[52] U.S. Cl. ..... 428/229; 8/529; 8/531; 8/532; 8/533; 428/259; 428/903

[58] Field of Search ..... 428/257, 258, 428/259, 903, 229; 8/529, 531, 532, 533

[56] References Cited

U.S. PATENT DOCUMENTS

| | | | |
|---|---|---|---|
| 776,275 | 11/1904 | Valentine et al. . | |
| 1,139,705 | 5/1915 | Murch . | |
| 2,147,736 | 2/1939 | Dreyfus . | |
| 2,153,964 | 4/1939 | Lejeune . | |
| 2,287,139 | 6/1942 | Schneider . | |
| 2,312,089 | 2/1943 | Gobielle . | |
| 2,384,936 | 9/1945 | Lilley et al. . | |
| 2,417,320 | 3/1947 | Nutter . | |
| 2,942,327 | 6/1960 | Corry . | |
| 3,069,746 | 12/1962 | Scharf . | |
| 3,145,132 | 8/1964 | Seltzer . | |
| 3,146,575 | 9/1964 | Lund et al. . | |
| 3,290,752 | 12/1966 | Ormand . | |
| 3,316,610 | 5/1967 | Manock . | |
| 3,400,004 | 9/1968 | Corry . | |
| 3,438,842 | 4/1969 | Petterson et al. . | |
| 3,446,658 | 5/1969 | Rose . | |
| 3,484,332 | 12/1969 | Fuhr . | |
| 3,642,561 | 2/1972 | Grobner . | |
| 4,136,221 | 1/1979 | Okamoto et al. . | |
| 4,191,221 | 3/1980 | Boyer . | |
| 4,209,559 | 6/1980 | Wada et al. | 428/91 |
| 4,300,902 | 11/1981 | Connor . | |
| 4,342,565 | 8/1982 | Teague et al. . | |
| 4,443,226 | 4/1984 | Röhser . | |
| 4,533,594 | 8/1985 | Buchanan . | |
| 4,573,500 | 3/1986 | Bouglas . | |
| 4,578,306 | 3/1986 | Heiman . | |
| 4,634,625 | 1/1987 | Franklin . | |
| 4,661,116 | 4/1987 | Barwick, III et al. | 8/532 |
| 4,670,326 | 6/1987 | Heiman . | |
| 4,678,473 | 7/1987 | Vigo et al. . | |
| 4,724,183 | 2/1988 | Heiman . | |
| 4,801,303 | 1/1989 | Carlough et al. . | |
| 5,070,915 | 12/1991 | Kalin . | |
| 5,256,475 | 10/1993 | Koyanagi et al. . | |
| 5,299,602 | 4/1994 | Barbeau et al. . | |

FOREIGN PATENT DOCUMENTS

| | | | |
|---|---|---|---|
| 0563757 | 10/1993 | European Pat. Off. . | |
| 51-049984 | 10/1973 | Japan . | |
| 50-024586 | 3/1975 | Japan . | |
| 57066-178 | 10/1980 | Japan . | |
| 59-199837 | 11/1984 | Japan . | |
| 61-119787 | 6/1986 | Japan . | |
| 2-84590 | 3/1990 | Japan . | |
| 2-154081 | 6/1990 | Japan . | |
| 4-041738 | 2/1992 | Japan . | |
| 4-034016 | 2/1992 | Japan . | |
| 4-343736 | 11/1992 | Japan . | |
| 5-98566 | 4/1993 | Japan . | |
| 609946 | 10/1946 | United Kingdom . | |
| 1059567 | 2/1967 | United Kingdom . | |
| 1208801 | 10/1970 | United Kingdom . | |
| 1221399 | 2/1971 | United Kingdom . | |
| 1296778 | 11/1972 | United Kingdom . | |
| 1337702 | 11/1973 | United Kingdom . | |
| 1446955 | 8/1976 | United Kingdom | D06P 3/84 |

*Primary Examiner*—James D. Withers

*Attorney, Agent, or Firm*—Willian Brinks Hofer Gilson & Lione

[57] ABSTRACT

A woven fabric is made of warp threads and weft threads. The warp threads have a different composition than the weft threads and at least one of the warp threads or weft threads is comprised of a multifilament fibre. The fabric is colored after it is manufactured by preferentially coloring the warp threads with a dyestuff which is preferentially taken up by the warp threads, but substantially repelled by the weft threads, and a different dyestuff which is preferentially taken up by the weft threads and substantially repelled by the warp threads. The resulting fabric can exhibit the shot silk effect.

18 Claims, 1 Drawing Sheet

TEXTILE FABRICS OF DIFFERENTIAL WEAVE COMPRISING MULTIFILAMENT THREADS WHEREIN INDIVIDUAL FILAMENTS HAVE A LINEAR DENSITY OF ONE DECITEX OR LESS

CLAIM OF BENEFIT OF FOREIGN PRIORITY

Applicant(s) claim foreign priority benefits under 35 U.S.C. §119 of the United Kingdom application for patent or inventor's certificate entitled "TEXTILE FABRICS," filed Mar. 21, 1994, the entire contents of which are incorporated herein by reference. A copy of the Great Britain application or inventor's certificate is attached.

BACKGROUND OF THE INVENTION

1. Field of the Invention

This invention relates to textile fabrics, and more particularly to processes for the manufacture of textiles, and the resulting cloth which is characterized by its color effects, and its smooth silky surface and handle.

The principal field of this invention is in the manufacture of wide width sheeting. This cloth is manufactured commercially in very great quantity, and finds particular utility for furnishing fabrics, bed linen and table linen.

2. Discussion of Art

At the present time, blended basecloth which is conventionally used for wide width sheeting is woven uniformly from a warp and weft of completely blended polyester and cotton spun yarn. The blended yarn is usually treated, before or after weaving, with optical whites, to give the highest possible uniformity and enhancement of solid color when dyed.

The cloth woven in this manner can be dyed by the piece in a range of plain solid colors, or can be pigment printed, for which it is equally suited. It is kept cheaply in stock ready for color treatment in either of the above ways. After dyeing or printing, the cloth can be finished by a simple heat treatment. Massive quantities of 50/50 blend polyester/cotton are woven cheaply and used routinely and uniformly by mills throughout the United States of America.

The effect of shot silk is well known. This is an iridescent play of colors produced by weaving silk with differently colored warp and weft yarns. The apparently straightforward approach of dyeing the blended polyester/cotton yarns differently for the warp and weft and then weaving the cloth as required is prohibitive for economic reasons. The blended wide width sheeting industry is built on the economic necessity for long production runs to meet its wide distribution. Each mill makes a financial investment in the commercially accepted yarns, of which about 65% are blended polyester/cotton yarns, and about 35% are 100% cotton yarns, which are woven in the universally accepted basecloths at their accepted price points. This commodity cloth is held in stock as a general resource for either dyeing or printing, leaving the economic flexibility of being able to meet the end users specific needs/demands. Additionally, the traditional method by weaving to produce the shot silk effect would require mills to keep huge stock of different pre-dyed yarns to meet the different orders.

SUMMARY OF THE INVENTION

One object of the invention is to impart color finishes to sheeting and other textiles with a design scope that extends beyond the color finishes that can be and are obtained with the presently known techniques.

Another object of the invention is to provide a woven cloth made from available and relatively inexpensive materials which can be custom colored with at least two different colors to produce a colored cloth having appearance very similar to that of shot silk.

Yet another object of this invention is to introduce complex effects similar to those of shot silk into bulk woven sheeting.

The present invention concerns aspects of the processes and textiles described below. The scope of the invention extends to all novel aspects thereof whether individually or in combination with other features as described herein.

It is proposed in accordance with the present invention to provide a manufacturing and coloring process which is suitable for wide sheeting, which allows the cloth to be woven economically and consistently in long runs and in bulk, which does not require stocks of different colored pre-dyed yarns, and yet which permits flexible and versatile production of color play effects in the cloth.

Expressed in general terms, the invention provides a fabric for coloring, by dyeing or printing, woven from at least two component yarns. These yarns are not usually dyed or printed until after the cloth has been woven, so that a single consistent greycloth can be woven in a long run on a loom, and held in stock until a later stage when the final question of color need only be addressed before the cloth is finished and sold. This is achieved by using a plurality of dyestuffs which are separately compatible with different fibre types of the yarns in the weave.

The woven fabric of the invention comprises warp threads and weft threads. At least one of the warp threads or the weft threads is comprised of a multifilament yarn and the warp threads have a different composition than the weft threads.

A more particular process of the invention for the manufacture of textiles comprises the steps of:

providing a first yarn and a second yarn, at least one of which is a multifilament yarn, the other is optionally a spun fibre yarn (also referred to herein as "spun yarn fibre") in which the first yarn is of a different composition than the second yarn;

weaving a fabric of warp and weft threads from the first and second yarns, so that one yarn provides the warp threads and the other yarn provides the weft threads; and coloring the woven fabric by a method comprising the application of at least two different dyestuffs selected with regard to the compositions of the warp and weft threads so that at least one such dyestuff is preferentially taken up by the warp threads and at least one such dyestuff is preferentially taken up by the weft threads, with the result that the warp and weft threads become differently colored and the woven fabric exhibits a play of colors to the eye upon inspection.

When one of the yarns is a spun fibre yarn, it is usually more practicable to use the spun fibre yarn as the warp. The invention includes a woven fabric comprising different warp thread and weft thread compositions, the respective warp threads and weft threads being differently colored after weaving.

The present invention achieves several advantages. The play of colors produced by the dyed or printed fabric of the invention is a shot effect, that is to say a color effect which is clearly perceptible in a fabric with a warp of one color and a weft of a contrasting color. Transient iridescent shimmer of the kind associated with shot silk is promoted by the use of the multifilament thread.

DETAILED DESCRIPTION OF THE INVENTION

Figure 1:
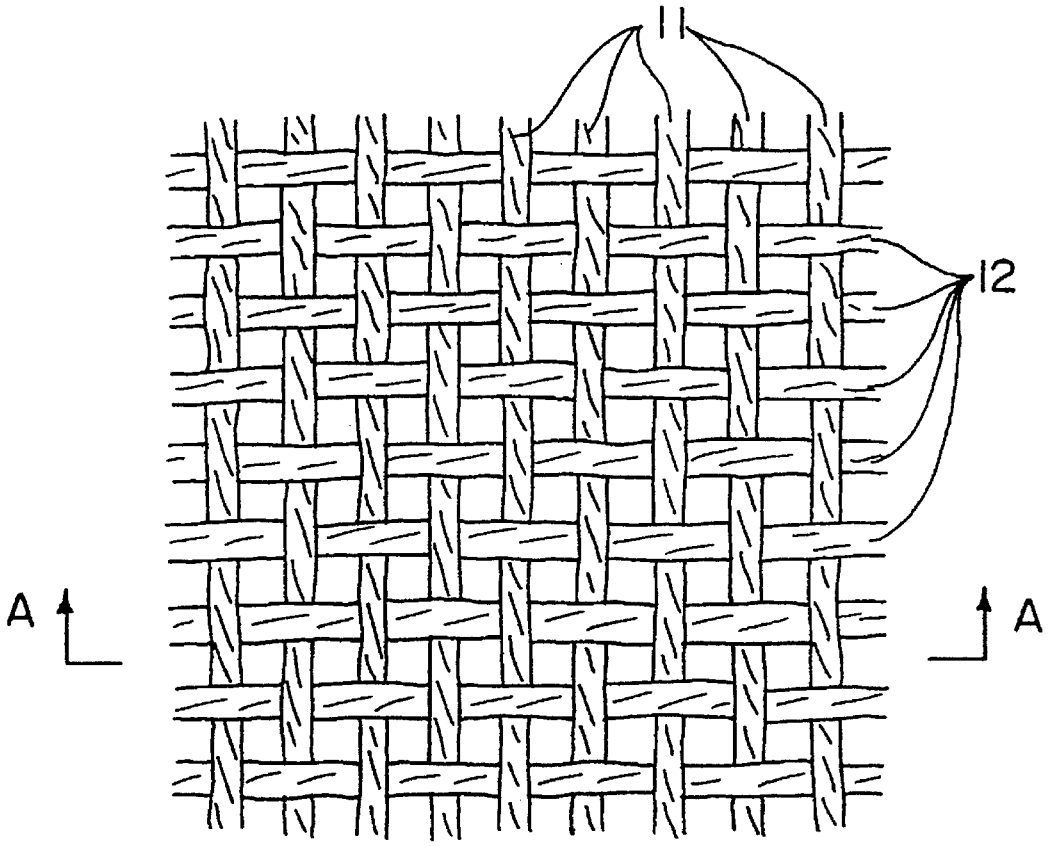
FIG. 1 is a plan view of a small area of cloth, much enlarged, and with exaggerated thread spacing, for the sake of clarity.

The fibres for making the warp threads are also referred to herein as "warp yarn" or "warp fibres," and the fibres used for making the weft threads as "weft yarn."

The spun yarn fibres are usually of relatively short lengths, such as about ½ to about 3 inches. Cotton fibres would be shorter, some flax and animal hairs (fibres) would be longer. In this sense, most natural fibres are short, including vegetable fibres such as cotton and flax, and animal fibres such as wool and hair.

The extruded filaments of silk are exceptional. Filaments, as used herein and in contrast to spun yarn fibres, are sufficiently long that they can be considered for practical purposes to be continuous. More so-called man made fibres are manufactured as continuous filaments. These include polyester, polyamide, polyacrylic, polypropylene, and regenerated cellulose. All of the above filaments, including silk, can be used to make the multifilament yarn from many continuous filaments. If polypropylene is used as the multifilament yarn, it is preferably colored with a suitable coloring agent in the molten, polymer state before it is extruded into a filament. A suitable coloring agent is a dispersed metallized pigment. Short fibres for spun yarns can be made from filaments by chopping or by other processes. Thus, the invention encompasses a fabric and a process for making thereof wherein one of the yarns is a multifilament yarn made from one of the above filaments and the other yarn is a spun fibre yarn made from a different filament.

The fibre compositions for the spun yarn are preferably natural or modified natural fibres, including cotton, linen, flax, and wool, and include regenerated cellulose (such as rayon).

The continuous multifilament yarn will frequently comprise a synthetic material characterized by a different dyestuff response than the spun fibre yarn. Microfibres are preferred for use as the multifilament yarn, with a linear density of 1 decitex or less, i.e. a fineness below one denier, in round figures. The filaments may be surface treated or textured, to improve their properties, as is known in principle in the textile art.

The methods of weaving the fabric are essentially conventional. For example, the fabric may be woven on rapier, air jet, water jet, terry or conventional shuttle looms, with or without dobby or jacquard capabilities. Weaving is intended also to include those knitting techniques that use both warp and weft threads, i.e. have different threads extending crosswise to one another. Combination warp and weft knitted fabrics, such as warp knitted fabrics with weft insertion, meet this requirement. Warp knitted fabrics may be produced on single or multi-bar knitting machines.

Generally, a plain square weave, in combination with a substantially even density of the warp and weft threads, is the preferred construction for the fabrics. Such fabrics have approximately equal numbers of ends (warp threads) per inch and picks (weft threads) per inch, or other unit length, and if the yarns are of similar bulk an even cloth will result. The two yarns most preferably have a distribution ratio of approximately 50:50, with deviation of plus or minus 10% from the 50:50 ratio of the warp threads to the weft threads, i.e. up to about 45:55. An approximate 40:60 or wider split will often be acceptable provided the final color effect is consistent with the objects of this invention. Any of the above distribution ratios may lead to as much as an approximate 70:30 ratio in terms of total fibre composition calculated on a weight for weight basis.

Any weave (or knit) that gives the desired visual effect can be used. Typical ground weaves are a 1×1 plain weave or a 2×2 twill weave, which will both show similar amounts of warp and weft yarn, provided they are of a similar thickness. The cloth may be patterned at intervals by the use of a jacquard or dobby to introduce variations from this ground.

Coloring includes both dyeing and printing. Dyestuffs may be applied simultaneously or sequentially according to the compatibility of the conditions needed for each chosen dyestuff. Generally, any coloring processes that are suited to the respective yarn/dyestuff combinations can be used. The invention requires separate dyestuffs to be used for each fibre and filament type, so that the dyestuff taken up predominantly by the warp yarn is different from that taken up predominantly by the weft yarn. It may be necessary to strip off color from the 'wrong' yarn after any dyeing stage, but with careful selection of dyestuffs and yarns there should be insufficient cross coloration to interfere with the desired contrasting coloration and resultant shot effect.

Suitable dyestuff types for dyeing and printing include pigment, vat, reactive, disperse, acid, sulphur, azoic, premetallized, modified basic dyes, and combinations thereof.

In general, the invention can utilize any dyeing or printing techniques, in conjunction with any dyestuff, that are tolerated by the cloth as a whole and by the individual warp and weft yarns, provided that the result is selective contrasting coloration of the warp and weft yarns in the woven cloth by the different dyestuffs used.

A suitable first dyestuff for the spun yarn fibres is any dyestuff which is taken up by such fibres, but has little, if any, affinity for the multifilament yarn. Some specific first dyestuffs are exemplified as follows: reactive, vat, direct, sulfur or azoic dyes for cotton, linen, flax and regenerated cellulose; acid, acid levelling and premetallized dyes for wool.

A suitable second dyestuff for the multifilament yarn is any dyestuff which is taken up by the multifilament yarn, but has little, if any, affinity for the spun yarn fibres. Some specific second dyestuffs are exemplified as follows: acid, premetallized or disperse dyes for polyamide; basic, modified basic or disperse dyes for polyacrylic; acid, premetallized, or acid levelling dyes for silk.

Dyeing may be a continuous or batch process, or a combination. Continuous dyeing may be carried out in a single stage, or in two or more stages with intermediate fixing procedures.

Part continuous, part batch process dyeing may include the following variations:

1. Pad, dry, bake, chemical pad, develop, wash; high temperature dyeing if required.
2. Cold pad batch, rotate, wash, dry, pad, dry, bake; high temperature dyeing if required.
3. Jig dye, develop, wash, dry; high temperature dyeing if required.

4. Beam dye, develop, wash, dry; high temperature dyeing if required.
5. Winch or jet dye, develop, wash, dry; high temperature dyeing if required.

Printing may be carried out on prepared for print ground, i.e. undyed bleached cloth, or by overprinting on dyed ground with the shot color effect. Printing enables selected areas to be dyed differently. Coloring may again be simultaneous, using two or more dyes in the same paste, or sequential.

Typical printing processes include flat screen printing, rotary screen printing, engraved roller printing, heat transfer printing and jet or spray printing.

Any required finishing process can be used, selected from the finishing techniques applied to a cloth woven from differently colored yarns.

Chemical finishing may include the application of softeners and sewing lubricants; resin stabilizers; soil and body fat resistant chemicals; proofing agents; dye and print resisting agents; and fire retardants.

Mechanical finishes may include brushing or raising, and cropping; sanding, peaching or sueding; calendering, plain shell or engraved lines; embossing; and blanket compacting or relaxation or softening processes.

Figure 2:
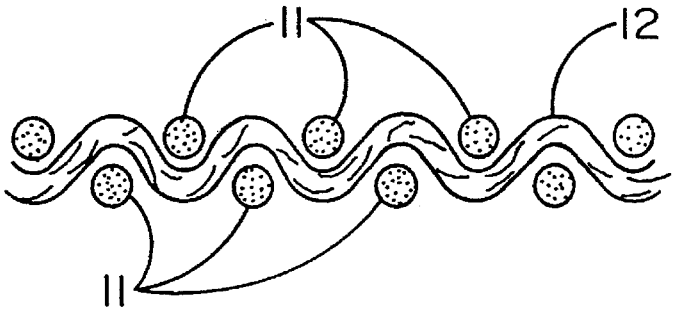
FIG. 2 is a sectional view of the same piece of cloth, to the same scale, taken on the line A-A in FIG. 1.

The following nonlimiting examples illustrate the invention. In each case (Examples 1, 2 and 3) a plain weave is used, as illustrated in the accompanying drawings of FIGS. 1 and 2.

In the drawings, it can be seen that the plain weave, also known as a linen weave, consists of warp threads 11 interwoven with weft threads 12, each thread of warp and weft alternatively passing over and under the consecutive weft or warp threads, respectively. Each thread shows equally, and the cloth would present the same appearance on the other side. In practice the threads would be more tightly woven together than appears from the somewhat diagrammatic drawings.

EXAMPLE 1

(Woven cotton/polyester microfibre fabric—continuous single pass dyeing process)

A cloth is woven on a Picanol air jet loom as follows.

Warp yarn: ring spun combed 100% cotton fibre, cotton count 1/40s.

Weft yarn: polyester microfibre type 'Fortrel' manufactured by Welman Inc.; 70 denier, 129 filaments.

Construction: plain weave, 104±1% ends per inch, 94±2% picks per inch. Threads per inch: 198 loomstate, minimum 200 finished.

Weight composition: 66% cotton, 34% polyester.

The woven cloth is then subjected to the following processing stages, including simultaneous dyeing of both warp and weft yarns.

Process water specification:

| | |
|---|---|
| pH | 7.0 ± 0.5 |
| Copper: | 0.05 mg/l max. |
| Iron: | 0.05 mg/l max. |
| Chloride ions: | 300 mg/l max. |
| Hardness: | Temporary carbonate - permitted<br>Permanent = 20 parts per 100,000 water max.<br>= 14° maximum average |
| Preferred water softening: | Ion exchange (removal of all ions except heavy metals) to zero + 5 deg. variation |

Preparation

Preliminaries include singeing, one or two sides, and a 10 hour enzyme desize followed by washing off.

Thereafter:

Continuous scour and peroxide bleach

Fully mercerize at 60° Twaddell

Conclude with final bath, containing peroxide killer and acetic acid to neutralize any carry over alkalinity.

Dyeing

Pad apply disperse and reactive dyes, together with all necessary chemicals, in sequence:

Dry—thermofix—wash—dry—ready for chemical finish. Cotton reactive dyes must be highly reactive and easily washed off; polyester disperse dyes must be alkaline resistant.

1) Pad apply dye/chemicals (55% nip expression) with a liquor containing:

| | |
|---|---|
| Procion Yellow MX-8G | 0.95% calculated on total weight of fabric run (used for the cotton warp) |
| Dispersol Blue XF | 1.00% calculated on total weight of fabric run (used for the polyester weft) |
| Matexil FA-MIV | 15 g/l |
| Lenetol WLF 125 | 1.5 g/l |
| Urea | 50 g/l |
| Sodium bicarbonate | 5 g/l |
| Sequestering agent - high temperature type (Products supplied by ICI/Zeneca) | 1 g/l (if necessary) |

2) Infra-red pre-dry to prevent migration

3) Hot flue dry—60 seconds at 110° C.

4) Thermofix—60 seconds at 210° C.

5) Wash off sequence

Using a minimum of an 8 box wash unit

Bath 1—soap boil) Zetex HP-LFN 0.5 g/l

Bath 2—soap boil) Caustic Soda 1.5 g/l

Bath 3—boiling water

Bath 4—boiling water

Bath 5—boiling water

Bath 6—boiling water

Bath 7—water at 70° C.

Bath 8—cold water rinse

6) Dry—hot cylinder dry onto A frames

Chemical Finish a) Pad apply (60% nip expression) at 20° C. a liquor of pH 4–4.5 containing:

| | |
|---|---|
| Acetic acid | 2 ml/l |
| Knittex LE conc. | 45 g/l |
| Knittex Catalyst MO | 10 g/l |
| Oleophobol PF | 25 g/l |

b) Stenter dry—2 chambers at 110°–120° C.

c) Stenter polymerize in 3 chambers at 180° C. for 60 seconds (Chemical products from Ciba)

Mechanical Finish

Cold plain shell calender

The resultant cloth, with a yellow dyed cotton staple warp and a blue dyed polyester multifilament weft, is of an overall green coloration shot through with yellow and blue lights and exhibits distinct color plays when turned through different viewing angles.

EXAMPLE 2

(Woven cotton/polyester microfibre fabric—single pass printing process)

A fabric woven as described in Example 1 is printed and finished as follows:

Preparation

1) Singe
2) Desize
3) Scour and peroxide bleach
4) Fully mercerize—60° Tw caustic soda (33°Be)
5) Stock paste preparation using sodium alginate thickener:

| | |
|---|---|
| Manutex F 10% solution | 500 pts |
| Matexil FA-N | 5 pts |
| Urea | 100 pts |
| Water to | 1000 pts |

6) Print paste formulation:

| | |
|---|---|
| Stock paste | 750 pts |
| Procion Yellow SP-SG (used for the cotton warp) | 15 pts |
| Dispersol Blue R-PC liquid (used for the polyester weft) | 16 pts |
| Water to | 1000 pts |

A sequestering agent (e.g. Lanapex HTS) may be added up to a maximum of 10% of the total weight of sodium alginate solid.

7) Print on a rotary or flatbed machine
8) High temperature steam fixation; e.g. Stork steamer (or equivalent)—10 minutes at 175° C.
9) Wash off sequence—multi-bath washer Bath 1—cold water rinse/overflow Bath 2—cold water rinse/overflow Bath 3—set at pH12 with 2 g/l caustic soda flake at the boil Bath 4—set at pH12 with 2 g/l caustic soda flake at the boil Bath 5—set at pH12 with 2 g/l caustic soda flake at the boil Bath 6—set at pH12 with 2 g/l caustic soda flake at the boil (Baths 3, 4, 5 and 6—3 minutes duration each)

Bath 7—rinse at 70° C. in water

Bath 8—cold water rinse

10) Dry—hot cylinder dry onto A frames
11) Chemical finish: Pad apply, 60% nip expression at 20° C. a liquor of pH 4–4.5 containing:

| | |
|---|---|
| Acetic acid | 2 ml/l |
| Knittex LE conc. | 45 g/l |

-continued

| | |
|---|---|
| Knittex Catalyst MO | 10 g/l |
| Oleophobol PF | 25 g/l |

12) Stenter dry—2 chambers at 110°–120° C.

Stenter polymerize in 3 chambers at 180° C. for 60 seconds

Mechanical Finish

Cold plain shell calender

The dyes and chemicals used originate from Zeneca (ICI) and Ciba.

The printed cloth exhibits a similar appearance to the fabric produced in Example 1.

EXAMPLE 3

(Woven cotton/polyamide fabric, semi-continuous dyeing)

A cloth is woven as follows:

Warp yarn: 100% American strict middling cotton fibre free of polypropylene contamination, average fibre length 11/16 inch (27 mm) combed spun count 1/40s.

Weft yarn: 100% type 66 polyamide multifilament microfibre, 70 denier (7.8 tex), 120 filaments.

Construction: Plain weave

Process water specification:

| | |
|---|---|
| pH | 7.0 ± 0.5 |
| Copper: | 0.05 mg/1 max. |
| Iron: | 0.05 mg/1 max. |
| Chloride ions: | 300 mg/1 max. |
| Hardness: | Temporary carbonate - permitted<br>Permanent = 20 parts per 100,000 water max.<br>= 14° maximum average |
| Preferred water softening: | Ion exchange (removal of all ions except heavy metals) to zero + 5 deg. variation |

Fabric preparation for coloring:

a) Singe—if required, on both sides b) Desize—enzyme, stand for 10 hours, wash off c) Scour and/or scour bleach according to color shades to be applied:

A minimum of an 8 bath continuous range, to provide alkaline scour, washes, peroxide bleach, washes, followed by peroxide killer wash.

The cloth may require to be additionally causticized, using 12–15% caustic soda, or fully mercerized, using 28% caustic soda, to meet specific handle and lustre requirements.

After testing for starch removal and absorbency, the fabric is stored on A frames before proceeding with dyeing/printing.

Dyeing is performed sequentially on the warp and weft yarns, in a semi-continuous part batch process. The cotton warp is dyed first, as follows:

a) Pad apply (55% nip expression) the dye liquor containing high migration, high reactive type reactive dye (e.g., for a yellow warp color Procion Yellow MX-8G 1% calculated on total weight of fabric run), migration inhibitor, wetting agent (e.g., Irgapadol PN-10 g/l), and sodium carbonate b) Infra red pre-dry c) Low temperature cylinder dry=110° C. maximum d) Baking unit=150° C. for 60 seconds e) Wash off multi box washer
40° C. wash
2×soap boil off
133 50° C. wash off
1×cold wash off
1×acid rinse at 40° C. with acetic acid f) Cylinder dry onto A frames, 3000 yard batches The polyamide weft is subsequently dyed as follows:

a) Pad apply (100% nip expression or as near as possible) a liquor containing acid levelling dye (e.g., for a blue weft Nylosan Blue E-BRL 0.9% calculated on total weight of fabric run) or premetallized dyes, with wetting agent (e.g. Irgapadol PN—10 g/l) at a pH of 6.0–6.5 (5.0–5.5 for heavy shades) using a buffer solution containing non-volatile acids e.g. citric acid.

b) High temperature steamer 15–20 minutes at 105° C.–107° C.

c) Wash off
4×soap boil
2×50° C. water d) Cylinder dry—2×cold water e) Stenter dry and set 5 chamber stenter, partially dry in chambers 1 and 2;

Heat set 180° C. for 25 seconds in chambers 3, 4, 5.

At this stage, finishing and stabilizing agents can be pad applied, dried in the first two bays, then simultaneously set and polymerized in the last three bays. The polymerization composition includes:

Thermosetting resin—dimethyloldihydroxyethylene urea type (e.g. Fixapret CPNS)

Acid catalyst

Softener—usually cationic

Fluorocarbon—for oil and body fat resistance

Wetting agent

Mechanical Finishes

Sanding, sueding, compacting, peaching, raising or cropping. These can be applied before or after chemical finishing, in any combination to obtain the end finish required.

Alternative dyeing routes for woven cotton/polyester microfibre cloth include the following:

a) Pad, steam, pad, thermofix, pad, steam, wash, dry b) Double bake, pad, thermofix, pad, steam, wash, dry c) Double bake and reduction clear—as above (b) and extra pad, steam, wash, dry d) Thermosol and pad batch e) Several other variations of the above processes f) Discontinuous batch dyeing In the same way, other yarn fibre combinations can be woven and dyed in accordance with the invention. Using cotton as the preferred warp yarn, the following weft yarns may be employed; in all these combinations, reactive or vat dyes are suitable for the cotton yarn.

| Weft | Dyestuffs |
|---|---|
| POlyamide | Acid dyes<br>Premetallized dyes<br>Disperse dyes |
| Polyacrylic | Modified basic dyes<br>Disperse dyes |

-continued

| Weft | Dyestuffs |
|---|---|
| Silk | Premetallized dyes<br>Acid dyes<br>Acid levelling dyes |
| Polypropylene | Solution dyed |

The embodiments described above provide a number of significant advantages. One of the principal benefits and advantages of the invention is that it provides a low cost mass production route to the bulk manufacture of wide width sheeting with color effects that have heretofore only been possible by substantially more expensive yarn dyeing methods. It is believed that this look by any method has never been produced for sheeting before. Numerous fibre combinations and dye and printing routes can be used in the invention to provide a wide variety of fabrics and visual effects. Furthermore, all the color effects can be overprinted to enhance the final appearance. The resulting fabric provides a luxurious and expensive look and feel. Accordingly, luxurious wide width sheeting for making furnishing fabrics, bed linen and table linen can be provided at a reasonable cost.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

I claim:

1. A woven fabric comprising warp threads and weft threads, the fabric exhibiting an iridescent play of color to the eye, wherein the weft threads consist solely of a multifilament microfibre yarn of individual filaments, each filament having a linear density of 1 decitex or less and the warp threads comprise one of cotton or other natural fibres having a bulk similar to the bulk of the microfibre yarn, the warp threads and the weft threads colored together after manufacturing the fabric with dyestuffs specifically directed to the innate structure of the warp threads and the weft threads, thereby producing a harmonious fabric of iridescent color wherein the weft threads have selectively a different color than the warp threads.

2. A woven fabric of claim 1, wherein the warp threads are comprised of a spun fibre yarn.

3. A woven fabric of claim 1, wherein the weft threads consist of man-made fibres.

4. A woven fabric of claim 1, wherein the warp threads are comprised of cotton, linen, flax or wool.

5. A woven fabric of claim 1, wherein the weft threads consist of polyester, polyamide, polyacrylic, polypropylene, regenerated cellulose or silk.

6. A woven fabric of claim 1, wherein the weft threads consist of man-made fibres or silk fibres.

7. A woven fabric of claim 1, wherein the weft threads consist of polyester and the warp threads are comprised of cotton.

8. A woven fabric of claim 7, wherein the warp threads are comprised of ring spun combed 100% cotton.

9. A woven fabric of claim 1, wherein the weft threads consist of polyamide and the warp threads are comprised of cotton.

10. A woven fabric of claim 1, wherein the weft threads consist of 100% type 66 polyamide multifilament microfibre and the warp threads are comprised of 100% American strict middling cotton fibre free of polypropylene contamination.

11. A woven fabric of claim 1, which is utilized for the production of wide width sheeting.

12. A woven fabric comprising warp threads and weft threads, the fabric exhibiting an iridescent play of color to the eye, wherein the warp threads consist solely of a multifilament microfibre yarn of individual filaments each filament having a linear density of 1 decitex or less and the weft threads comprise one of cotton or other natural fibres having a bulk similar to the bulk of the microfibre yarn, the warp threads and the weft threads colored together after manufacturing the fabric with dyestuffs specifically directed to the innate structure of the warp threads and the weft threads, thereby producing a harmonious fabric of iridescent color wherein the weft threads have a selectively different color than the warp threads.

13. A woven fabric of claim 12, wherein the warp threads consist of man-made fibres.

14. A woven fabric of claim 12, wherein the warp threads consist of polyester, polyamide, polyacrylic, polypropylene, regenerated cellulose or silk.

15. A woven fabric of claim 12, wherein the weft threads are comprised of cotton, linen, flax or wool.

16. A woven fabric of claim 12, wherein the warp threads consist of man-made fibres or silk fibres.

17. A woven, even fabric comprising warp threads and weft threads, the warp threads having a selectively different color than the weft threads, the fabric exhibiting an iridescent play of color to the eye, wherein the weft threads consist of a multifilament microfibre yarn of individual filaments, each filament having a linear density of 1 decitex or less and the warp threads consist of one of cotton or other natural fibres, the warp threads and the weft threads having similar bulk, the warp threads and the weft threads colored simultaneously after manufacturing the fabric with separate dyestuffs used for the warp threads and the weft threads, so that the dyestuff taken up predominantly by the warp threads is different from that taken up predominantly by the weft threads.

18. A woven, even fabric comprising warp threads and weft threads, the warp threads having a selectively different color than the weft threads, the fabric exhibiting an iridescent play of color to the eye, wherein the warp threads consist of a multifilament microfibre yarn of individual filaments, each filament having a linear density of 1 decitex or less and the weft threads consist of one of cotton or other natural fibres, the weft threads and the warp threads having similar bulk, the warp threads and the weft threads colored simultaneously after manufacturing the fabric with separate dyestuffs used for the warp threads and the weft threads, so that the dyestuff taken up predominantly by the warp threads is different from that taken up predominantly by the weft threads.

* * * * *